US009583849B1

(12) United States Patent
Wu

(10) Patent No.: US 9,583,849 B1
(45) Date of Patent: Feb. 28, 2017

(54) CONNECTOR MODULE WITH MULTIPLE CONNECTION MODES

(71) Applicant: Dinkle Enterprise Co., Ltd., New Taipei (TW)

(72) Inventor: Shang-Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 14/855,940

(22) Filed: Sep. 16, 2015

(51) Int. Cl.
*H01R 9/22* (2006.01)
*H01R 9/26* (2006.01)

(52) U.S. Cl.
CPC ..... *H01R 9/2675* (2013.01)

(58) Field of Classification Search
CPC ..... H01R 9/2675
USPC ..... 439/715, 327, 928, 188
See application file for complete search history.

(56) References Cited

U.S. PATENT DOCUMENTS 4,472,764 A * 9/1984 Richard ..... H01R 9/2625 361/775
4,897,054 A * 1/1990 Gilissen ..... H01R 12/7082 439/287
5,716,241 A * 2/1998 Hennemann ..... G06F 1/184 439/716
6,033,264 A * 3/2000 Feye-Hohmann ... H01R 9/2675 439/631
6,172,877 B1 * 1/2001 Feye-Hohmann ..... G06F 1/184 361/728
6,181,566 B1 * 1/2001 Feye-Hohmann ... H05K 7/1468 361/728
6,371,435 B1 * 4/2002 Landis ..... H02B 1/052 248/694
6,425,770 B1 * 7/2002 Lostoski ..... H01R 9/26 361/759
6,431,909 B1 * 8/2002 Nolden ..... H01R 9/2608 361/735
6,686,672 B2 * 2/2004 Brown ..... H05K 7/1471 307/125
6,767,223 B2 * 7/2004 Lostoski ..... H01R 9/26 361/759
6,840,819 B2 * 1/2005 Bet ..... H02B 1/052 439/157
7,402,058 B2 7/2008 Hoemann et al.
8,062,041 B2 * 11/2011 Nakamura ..... H01R 13/64 439/108

(Continued)

FOREIGN PATENT DOCUMENTS

WO WO 00/62376 10/2000

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

Disclosed is a tri-mode connector module comprising a module main body, a serial/parallel connector and a bus connector seat. The serial/parallel connector comprises a slot and groups of connection terminals, each including a first contact piece and a second contact piece. A foreign object enters the slot to change the connections of the first and second contact pieces, to establish serial or parallel connections. The bus connector seat comprises a rail to accommodate a bus connector and a slide clip to clip a bus rail. The connector module may further include a bus connector to connect a bus structure provided in the bus rail.

10 Claims, 5 Drawing Sheets

(56) References Cited

U.S. PATENT DOCUMENTS

| | | | | |
|---|---|---|---|---|
| 8,197,274 | B2 * | 6/2012 | Bodmann | H01R 13/33 439/188 |
| 8,668,518 | B2 * | 3/2014 | Wu | H01R 25/142 439/532 |
| 8,968,016 | B1 * | 3/2015 | Wu | H01R 9/2608 439/214 |
| 8,986,033 | B2 * | 3/2015 | Berger | H05K 7/1468 439/341 |
| 9,077,108 | B2 * | 7/2015 | Molnar | H05K 7/1468 |
| 9,112,318 | B2 * | 8/2015 | Cech | H01R 9/2675 |
| 9,118,124 | B2 * | 8/2015 | Buettner | H02B 1/052 |
| 2001/0034165 | A1 * | 10/2001 | Landis | H01R 13/6658 439/716 |
| 2010/0144178 | A1 * | 6/2010 | Braunlich | H05K 7/1474 439/135 |
| 2013/0027890 | A1 | 1/2013 | Berger et al. | |
| 2013/0237067 | A1 | 9/2013 | Wu | |

* cited by examiner

CONNECTOR MODULE WITH MULTIPLE CONNECTION MODES

FIELD OF THE INVENTION

The present invention relates to a multi-modal connector module, particularly a connector module providing three connection modes.

BACKGROUND OF THE INVENTION

In industrial control applications, various control circuits are formed in functional modules and a plurality of control modules is removably installed in a control system, to provide the system with different control functions. In order to satisfy such needs, i.e., the need of adding or removing particular module from time to time, each functional modules is provided with necessary connector modules, with a same number of electrical contacts at identical positions among all connector modules. In particular, the various functional modules form a flat cassette, with their electrical contacts formed in both sides of the flat cassettes at respectively corresponding positions, so that a cassette can establish electrical connections with another adjacent to either side of the other at the electrical contacts, in order to exchange signals or power.

U.S. Pat. No. 5,716,241 disclosed an "I/O Device for a Data Bus" including a connector module having such modularized connectivity. The connector module is accommodated in a module cassette.

In order to support connections of function modules, the industry has developed a connector module. The connector module has main body in the shape of a flat cassette, with a same number of contact pins at corresponding positions in its both sides, such that one other connector module, also in the shape of a cassette, can establish electrical connections at either side of the cassette. The contact pins of a pair form a T shape, with two pins respectively extended to both sides and a third pin extended in a perpendicular direction. As a general design, the third pin includes two elastic legs configured to clip an external connector, such as one of the goldfingers provided in a circuit board having a functional module. When the external connector is inserted in the third connector, the functional module in connection with the external connector establishes electrical contact with the T-shaped connector piece. That is, when no external connector is inserted, the T-shaped connector piece conducts laterally, called short circuit; when the external connector is inserted, the T-shaped connector piece additionally conducts the functional module in connection with the external connector. With such a connector structure, the functional module may form a "series" or "parallel" connection with other functional modules, depending on the design of the functional modules.

WO 00/62376A1 disclosed an "Input/Output Device Having Removable Module" that has a connector module provided with such function. A T-shaped connector piece for use in the connector module is also disclosed.

US 2013/0027890 disclosed a "Connection Module Being Capable of Serving a Bus" that uses a plurality of connector modules to form a bus structure. This connection module enables the so-called "bus" connection of the functional modules.

Providing a multiple modal connection function and changing the interconnection among contact pins by inserting a foreign object in a group of connectors were disclosed in U.S. Pat. No. 7,402,058, "Plug Connector with Short Circuit Contacts."

In response to the urgent needs for multiple modal functional modules in the industry, connector modules that support multi-modal connection functions are developed. The multi-modal connector modules provide a plurality of connection modes, for the functional module suppliers' selection. The multi-modal connector modules may be used in most functional modules, to connect other functional modules where varies electrical connection modes are used.

OBJECTIVES OF THE INVENTION

An objective of the present invention to provide a novel connector module that supports multiple connection modes for use by functional modules.

Another objective of this invention is to provide a tri-modal connector module that supports a parallel/serial connection mode and a bus connection modes.

SUMMARY OF THE INVENTION

According to the present invention, a connector module is provided and comprises:

a module main body, a serial/parallel connector detachably attached in the module main body, and a bus connector seat. The serial/parallel connector comprises:

an insulation main body having a slot; and at least one group of connection terminals fixed on the insulation body, each group of connection terminals including a first contact piece and a second contact piece; wherein the first contact piece provides an external first contact and internal second and third contacts, the internal second and third contacts being arranged along a first direction in the slot;

the second contact piece provides an external fourth contact and internal fifth and sixth contacts, the internal fifth and sixth contacts being arranged along the first direction in the slot and in resilient contact with the second and third contacts, respectively; and a width of the slot in the direction perpendicular to the first direction is enough to accommodate a foreign object, whereby when the external object enters into the slot in the first direction, contact between the second and fifth contacts or the third and sixth contacts is released. When the serial/parallel connector is assembled in the module main body, the first and fourth contacts of each connector pin group are positioned external at both sides of the module main body.

In addition, the bus connector seat is provided in the module main body and comprises:

a slide rail formed inside an opening of the module main body to provide slidable attachment and accommodation of a bus connector, a slidable clamp positioned at one end of the opening to be aligned to a bus rail, to clamp the bus rail for attachment of the connector module.

The opining provides a space along the slide rail and opened to the clamp, such that connector pins of the bus connector may reach a bus structure in the bus rail.

In the preferred embodiments of the invention, the first contact piece comprises a connection portion and a first elastic leg, a second elastic leg and a third elastic leg extended from the connection portion, such that the first contact, the second contact and the third contact are provided in the first elastic leg, the second elastic leg and the third elastic leg, respectively. In some preferred embodiments of the present invention, the second contact piece comprises a main body and a fourth elastic leg, a fifth elastic leg and a sixth elastic leg extended from the main body, such that the fourth contact, the fifth contact and the sixth contact are provided in the fourth elastic leg, the fifth elastic leg and the sixth elastic leg, respectively.

In some preferred embodiments of the present invention, when a foreign object is inserted into the slot along the first direction, the foreign object first contacts the second and fifth contacts. With the continued movement of the foreign object towards the first direction, connection of the second and fifth contacts is forced to break, therefore the contact status of the second contact and the fifth contact is released. The foreign object continues to move along the first direction and contacts the third contact and sixth contacts. With the continued movement of the foreign object, connection of the third contact and sixth contacts is forced to break, therefore the contact status of the third and sixth contacts is released.

The foreign object may provide an electrical contact at each side. The electrical contacts may be provided at locations corresponding to the second and fifth contacts, after the foreign object is fully inserted in the slot. The electrical contacts may also be provided at locations corresponding to the second and fifth contacts and extend to locations corresponding to the third and sixth contacts. The foreign object may be a circuit board and the electrical contacts may be goldfingers provided on the circuit board.

When the foreign object reaches the bottom of the slot and forces the third and sixth contacts to break, depending on the length of the electrical contacts the electrical contacts may form contact with the second and fifth contacts, only, or with the second, fifth, third and sixth contacts at the same time. In case the electrical contacts form contact with the second, fifth, third and sixth contacts, signals/currents that enter from the first contact and flow through connection of the second and fifth contacts and connection of the third and sixth contacts to the fourth contact without the foreign object being inserted will flow to the circuit provided in the circuit board through the electrical contacts and are output after they are processed/transformed. A serial connection of the circuit board is thus realized. On the other hand, if the electrical contacts only contact the second and fifth contacts, the signals/currents that enter from the first contact and flow to the fourth contact without the foreign object being inserted will split a flow to the circuit provided in the circuit board, because of the connection of the second and fifth contacts. The split flow is then output after it is processed and transformed. A parallel connection of the circuit board is thus realized.

In some preferred embodiments, the bus connector comprises a plurality of bus connector pins. The bus connector may enter into the opening along the first direction and move along the slide rail, until the connector pins of the bus connector are exposed from the other end of the opening. The bus rail may extend along a second direction perpendicular to the first direction, so that one bus rail supports a plurality of connector modules parallel arranged. In the bus rail a bus structure may be accommodated. The bus structure may include a bus structure main body to be accommodated in the bus rail and a plurality of metal strips each extending along the second direction and arranged parallel to other metal strips, to be connected by a plurality of bus connector arranged in sequence. The bus connector may also provide a plurality of modular connector pins, for connector pins of particular circuit module to connect. The bus connector may further provide a substrate, such as a circuit board, provided with circuit module(s) thereon. The substrate may provide an extension to be inserted into the slot of the serial/parallel connector.

The module main body of the connector module may extend to form a housing, or be connected with a housing, to accommodate the circuit module and/or the substrate.

When a plurality of the invented connector module is arranged on the bus rail in sequence, the first and fourth connector pins of the serial/parallel connector of one connector module respectively contacts the fourth and first connector pins of the serial/parallel connectors of its adjacent connector modules. When a bus connector is provided in the bus connector seat of a connector module, the bus connector pins of the bus connector electrically connects the metal strips of the bus structure provided in the bus rail.

These and other objectives and advantages of the present invention may be made clear from the detailed description by reference to the following drawings.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

DETAILED DESCRIPTION OF THE INVENTION

In the following, detailed description to the preferred embodiments of the connector module of this invention will be given by referring to the accompanying drawings. It is appreciated that the preferred embodiments are used to show the structure and the applications of some examples of the invention. The scope of protection of this invention shall be defined by the accompanying claims.

It is the objective of the present invention to provide a connector module that supports three connection modes, namely, the serial/parallel connections and bus connections among a plurality of functional modules.

Figure 1:
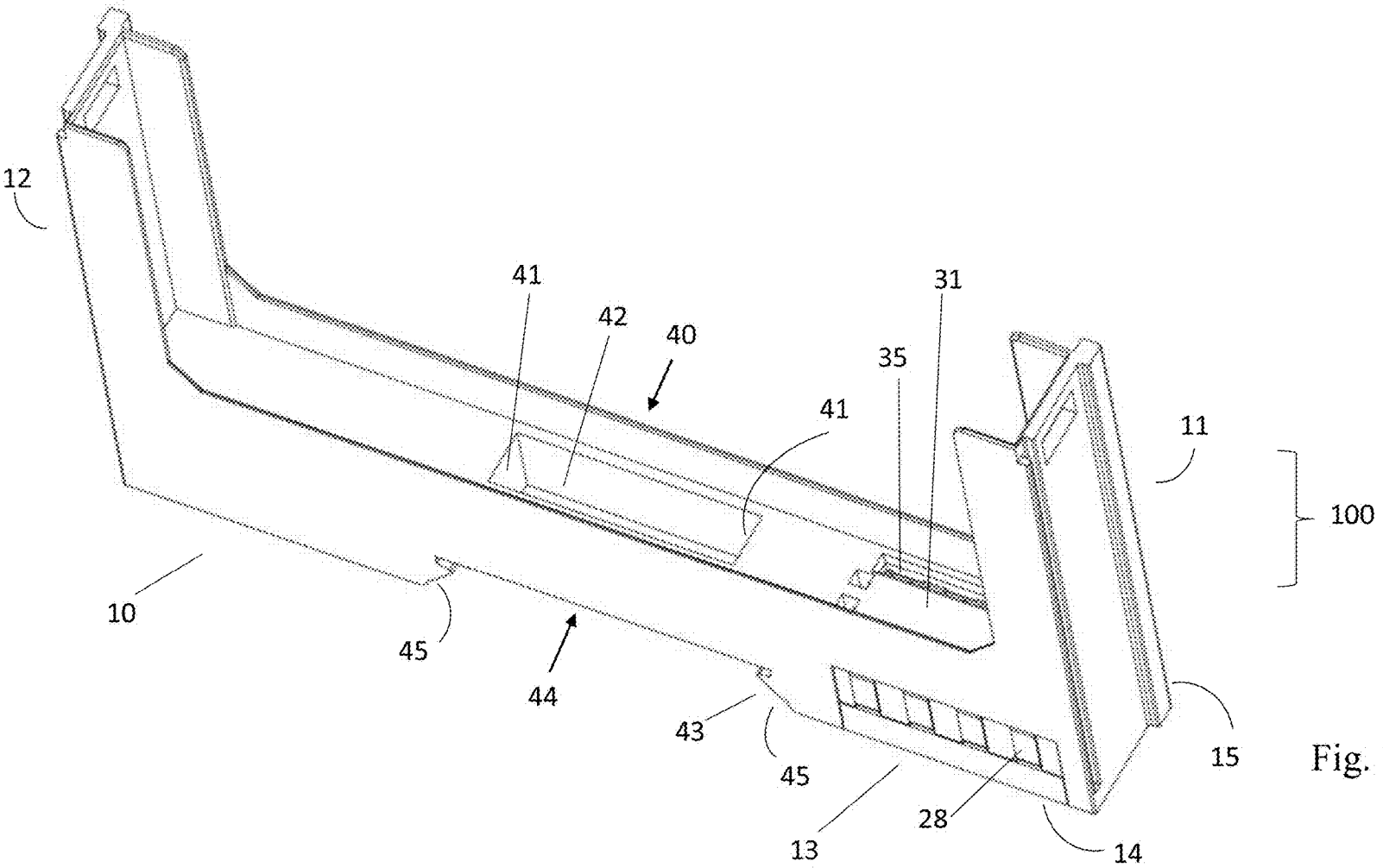
FIG. 1 shows the schematic view of one embodiment of the connector module of the present invention.

FIG. 1 shows the schematic view of one embodiment of the connector module 100 of the present invention. As shown, the connector module 100 of the present invention comprises a module main body 10, a serial/parallel connector 31 attached in the module main body 10, and a bus connector seat 40 provided in the module main body 10. In the example of FIG. 1, the serial/parallel connector 31 is detachably attached to the module main body 10. However, as may be appreciated by those having ordinary skills in the art, the serial/parallel connector 31 may be affixed to the module main body 10. Due to the orientation of the module main body 10 shown in FIG. 1, only connector pins that are exposed and the slot 35 of the serial/parallel connector 31 are shown.

FIG. 1 also shows a bus connector seat 40 provided in the module main body 10, in the form of an opening. The bus connector seat 40 includes slide rails 41, 41 formed in the opening 42 of the bus connector seat 40. The bus connector seat 40 also includes a slidable clamp 43, also formed in the module main body 10 but at an end of the opening 42 to be aligned to a bus rail 60 (See FIG. 9), so to clamp a bus structure 61 accommodated in the bus rail 60, such that the connector module 100 is attached, or slidably attached, to the bus rail 60. The shape and size of the opening 42 and the slide rails 41, 41 are not limited, as long as they provide sufficient space for the installation and detachment of a bus connector 50 (see FIG. 6), whereby the bus connector 50 may enter from the opening 42, move along the slide rails 41, 41 and accommodated in the space defined by the slide rails 41, 41. The opening 42 also opens along the slide rails 41, 41, such that, when the bus connector 50 is installed therein, its connector pins are extended external to the opening 42 and in connection with the bus structure 61 accommodated in the bus rail 60. The structure of the slide clamp 43 is not limited, as long as it is able to firmly clamp the bus rail, such as a standard support rail or a customized support rail, and the clamp situation may be easily released by a simple operation, so to remove the connector module 100. As the support rail is a standard component in the industry and provides slidability, the slidable clamp 43 is preferably slidable on the bus rail 60. The slidable clamp 43 shown in FIG. 1 is one of the clamps that have the simplest structure. It basically has a concave slot 44, to accommodate the two wings of the bus rail 60, and two angular projections 45, 45 at both edges of the slot 44, to clamp the bus rail 60. Other types of clamp, such as those with one spring-biased sliding block in substitution of the angular projection 45, are also applicable in this invention. Since the support rail is a standard component in the industry, details of the slidable clamp 43 is thus omitted.

In the module main body 10 shown in FIG. 1, two guide arms 11, 12 are formed at its both sides. In the internal side of the guide arms 11, 12, guide rails are provided, to guide and accommodate circuit board 70 (See FIG. 9) with functional circuit modules. If a bus connector 50 is provided in the circuit board 70, the bus connector 50 will enter the connector seat 40 and project from the slidable clamp 43 end of the opening 42, when the circuit board 70 is inserted in between the guide arms 11, 12. At the position where the slidable clamp 43 clamps the bus rail 60, the bus connector pins of the bus connector will contact the metal strips of the bus structure accommodated in the bus rail 60, to form electrical contacts, whereby bus connection between the connector module and the bus structure is formed. In addition, if an extension is provided in the circuit board 70, at a position corresponding to the slot 35, the extension will enter the slot 35, so to interact with the serial/parallel connector 31.

The shape of the module main body 10 is not limited to the shape shown in FIG. 1. For example, the module main body 10 may form a box, to provide housing to accommodate the circuit board 70, as well as circuits, components provided in the circuit board 70.

Figure 2:
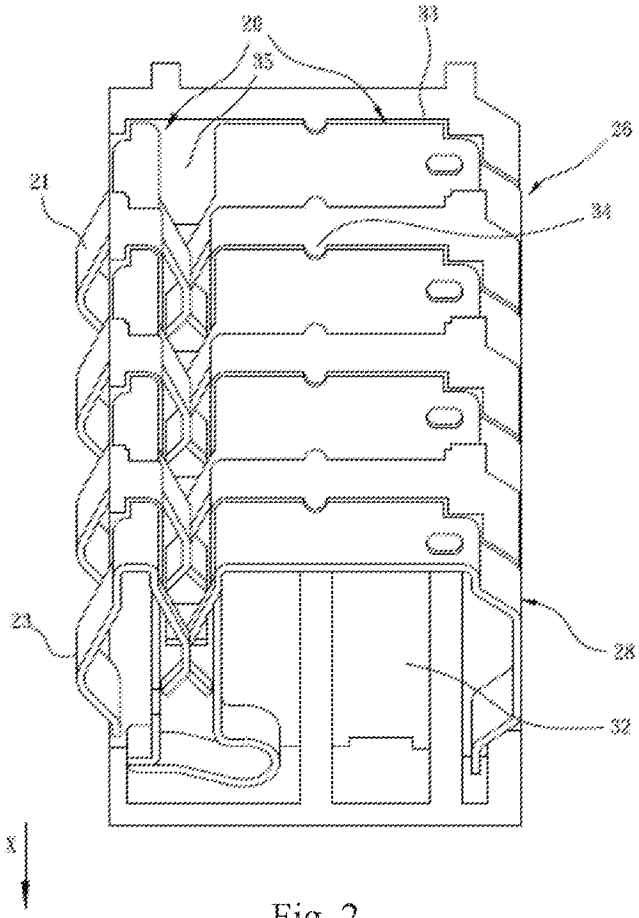
FIG. 2 shows the structural of one embodiment of a serial/parallel connector of the connector module of the present invention.

FIG. 2 shows the structural of one example of the serial/parallel connector 31 applicable in the connector module 100 of this invention. The figure shows four groups of connection terminal 20, as well as the side view of one of the connection terminal groups 20. As illustrated, in the present embodiment, the serial/parallel connector 31 includes an insulation main body 32, with 4 groups of connection terminals 20 detachably fixed in the insulation main body 32 via slots 33 and tabs 34. The arrangement of the connection terminal groups 20 in the insulation main body 32 is not limited to the way shown in this figure. Any method that is able to affix the connection terminal groups 20 may be used in this invention. For example, the connection terminal groups 20 may be affixed in the insulation main body by injection. Number of the connection terminal group 20 may also vary in accordance with needs in applications.

The insulation main body 32 provides a slot 35 extending along the longitudinal direction of the insulation main body 32. Its length and width are not limited but in general, its length is preferably sufficient to accommodate the predetermined number of connection terminal groups, while maintaining a predetermined distance between the groups. In addition, its width is preferably sufficient to accommodate the connection terminals therein, while leaving a space for a foreign objects, such as the circuit board 70, to be inserted therein.

Each group 20 of connection terminals shown in FIG. 2 comprises a first contact piece 21 and a second contact piece 26. As shown in the figure, the first contact piece 21 provides a first contact 23A, a second contact 24A and a third contact 25A, with the second and third contacts 24A, 25A located in the slot 35 and arranged along a first direction X in the slot 18. The figure also shows that the second contact piece 26 provides a fourth contacts 28A, a fifth contact 29A and a sixth contact 30A, with the fifth and sixth contacts 29A, 30A located within the slot 35 and arranged along the first direction X. In addition, the fifth and sixth contacts 29A, 30A respectively form resilient contact with the second and third contacts 24A, 25A.

Figure 3:
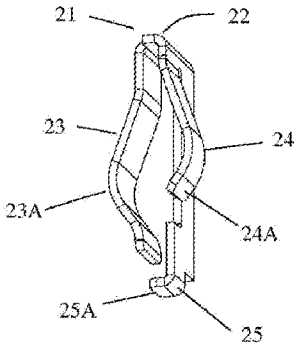
FIG. 3 is the oblique drawing of an embodiment of the first contact piece used in the serial/parallel connector of FIG. 2.

FIG. 3 shows the oblique view of an embodiment of the first contact piece 21 of the connection terminal group 20 of FIG. 2. As shown, in this embodiment the first contact piece 21 includes a connection portion 22 and first elastic leg 22, second elastic leg 24 and third elastic leg 25 extended from the connection portion 22. The first contact 23A, the second contact 24A and the third contact 25A are respectively provided in the first elastic leg 23, the second elastic leg 24 and the third elastic leg 25. When assembled, the second elastic leg 24 and the third elastic leg 25 of the first contact piece 21 are aligned with the slot 35 and inserted into the slot 35 so that the second and third elastic legs 24, 25 enter into the slot 35, while the first elastic leg 23 maintained external to the slot 35, until edge of the slot 35 is in contact with the connection portion 22.

Figure 4:
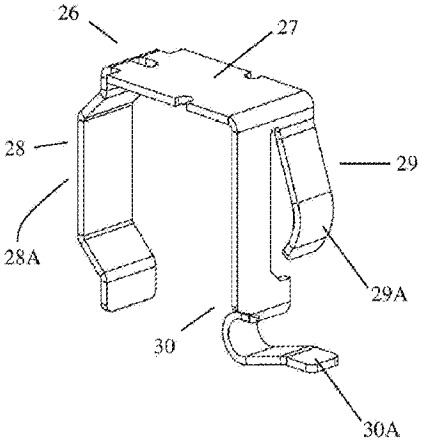
FIG. 4 is the oblique drawing of an embodiment of the second contact piece used in the serial/parallel connector of FIG. 2.

Now refer to FIG. 4. FIG. 4 shows the oblique view of an embodiment of the second contact piece 26 of the connection terminal group 20 of FIG. 2. As shown, in this embodiment the second contact piece 26 includes a main body 27 and fourth elastic leg 28, fifth elastic leg 29 and sixth elastic leg 30 extended from the main body 27. The fourth contact 28A, the fifth contact 29A and the sixth contact 30A are respectively provided in the fourth elastic leg 28, the fifth elastic leg 29 and the sixth elastic leg 30. Similar to the first contact piece 21, when assembled, the fifth elastic leg 29 and the sixth elastic leg 30 of the second contact piece 27 are aligned with the slot 35 and inserted into the slot 35 so that the fifth and third sixth legs 29, 30 enter into the slot 35, while the fourth elastic leg 28 maintained external to the slot 35, until edge of the slot 35 is in contact with the main body 27.

After assembly, in each of the connection terminal groups 20, the first contact 23A locates outside of one external side of the insulation main body 32 and the fourth contact 28A on the opposite external side of the insulation main body 32. The first elastic leg 23 and the fourth elastic leg 28 may be disposed in the external sides of the insulation main body 32 in full or in part, as long as they may form electrical contact with a group of identical or similar connection terminal belonging to another connector module.

In the example shown in FIG. 3, the extensions of the third elastic leg 25 and the second elastic leg 24 are separated by a space. Also, in the example shown in FIG. 4, the extensions of the sixth and fifth elastic legs 30 29 are separated by a space. However, in other examples, the second elastic leg 24 may be surrounded by the third elastic leg 25, with a space between them, to form a frame shape. Similarly, the fifth elastic leg 29 may be surrounded by the sixth elastic leg 30, with a space between them, to form a frame shape. Other designs in the type, shape or structure of the elastic legs are applicable and may be determined by those having ordinary skills in the art.

Now return to FIG. 1. The module main body 10 in FIG. 1 provides a seat 13 to accommodate the serial/parallel connector 31. In addition, openings 14, 15 are provided at both sides of the seat 13, such that the first and fourth contacts 23A, 28A of the serial/parallel connector 31, i.e., the first and fourth legs 23, 28 are exposed from the module main body 10, when the serial/parallel connector 31 is accommodated in the seat 13. When a plurality of connector nodules are arranged in sequence, such as when they are arranged in sequence in the bus rail 60, the first and fourth contacts 24A, 28/A of the serial/parallel connector 31 of one contact module are respectively in contact with the fourth and first contacts 28A, 24A of the serial/parallel connectors 31 of an adjacent contact module.

When the serial/parallel connector 31 of the invention is assembled, each group of the connection terminals 20 will have the second and third contacts 24A, 25A arranged along the first direction X within the slot 35, and the fifth and sixth contacts 29A, 30A arranged along the first direction X in the slot 35. The fifth and sixth contacts 29A, 30A form resilient contacts respectively with the second and third contacts 24A, 25A. The width of the slot 35 in the direction perpendicular to the first direction X is wide enough to accommodate a foreign object, such as the circuit board 70. Therefore, the foreign object 70 can enter the slot 35 to release the contact status of the second contact 24A with the fifth contact 29A, and the third contact 25 with the sixth contact 30A.

Figure 5A:
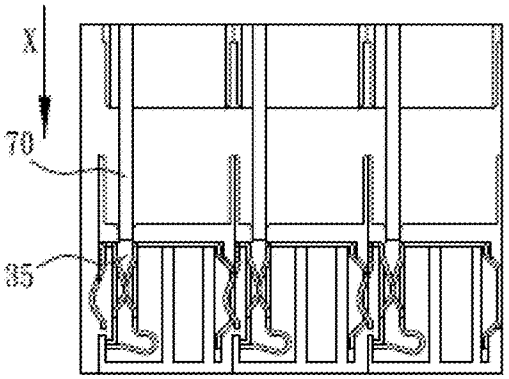
FIGS. 5A-5C show the cross-sectional view of the serial/parallel connector module of FIG. 2.
Figure 5B:
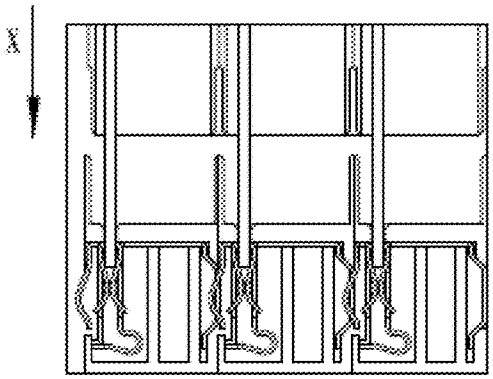
Figure 5C:
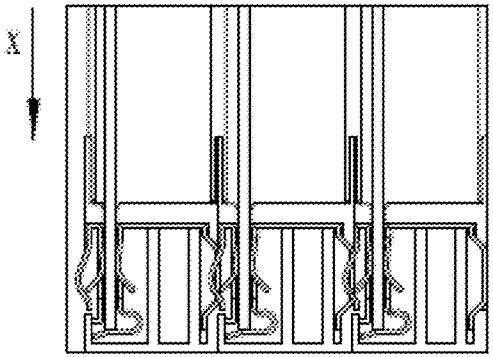

FIGS. 5A-5C illustrate the cross-sectional view of the serial/parallel connector 31 of the present invention, when application. As shown, in the state of FIG. 5A, the foreign object (the circuit board) 70 is just inserted into the slot 35, from the upper part of the figure to the lower part, but has not yet entered the slot 35. In this time point, the second contact 24A and the fifth contact 29A, and the third contact 25A and the sixth contact 30A, respectively, maintain in electrical contact.

In the state shown in FIG. 5B, the foreign object 70 first contacts the second contact 24 and the fifth contact 29, followed by a continuous movement to force the second contact 24 and the fifth contact 29 to break, therefore releasing the contact status of the second contact 24A and the fifth contact 29A. Thereafter, the foreign object 70 continues to move along the first direction X and contacts the third and the sixth contacts 25A, 30A. The continuous movement of the foreign object 70 forces the third and sixth contacts 25A, 30A to break, therefore releasing the contact status of the third and sixth contacts 25A, 30A, as shown in FIG. 5C.

In the preferred embodiments of this invention, an extension 71 is provided in the circuit board 70, at a location corresponding to the serial/parallel connector 31. Contact pins 72, such as goldfingers provided in both sides of the circuit board 70, are provided in the extension 71, at locations corresponding to the second contact 24A, the third contact 25A and the fifth contact 29A and the sixth contact 30A. The contact pins 72 will form electrical contacts with the second contact 24A and the fifth contact 29A and/or the third contact 25A and the sixth contact 30A, when the circuit board 70 is fully inserted in the slot 35. Depending on the length of the contact pins 72, the contact pins 72 may be provided at regions corresponding to the second contact 24A and the fifth contact 29A, to the third contact 25A and the sixth 30A or to second contact 24A and the fifth contact 29A and extending to regions corresponding to the third contact 25A and the sixth contact 30A.

When the circuit board 70 is inserted and reaches the bottom of the slot 35, forcing the third contact 25A to and the sixth contact 30A to separate, depending on the length of the contact pins 72, the contact pins 72 may form electrical contacts with the second contact 24A and the fifth contact 29A, with the third contact 25A and the sixth 30A or with all the second contact 24A, the fifth contact 29A, the third contact 25A and the sixth contact 30A. When the contact pins 72 contacts all the second contact 24A, the fifth contact 29A, the third contact 25A and the sixth contact 30A, signals/currents that enter from the first contact 23A, flow via the second and fifth contacts 24A, 29A and the third and sixth contacts 25A, 30A and exit from the fourth contact 28A, when the circuit board 70 is not inserted in the slot 35, will enter the circuit provided in the circuit board 70 from the contact pin 72, to be processed or transformed by the circuit. Results of the processing or transformation will be output to external via the contact pin 72 or otherwise. A serial connection of the circuit board is thus realized. On the other hand, if after insertion of the circuit board 70, the contact pins 72 form electrical contacts with the second and fifth contacts 24A, 29A, only, signals/currents that enter from the first contact 23A and exit from the fourth contact 28A, when the circuit board 70 is not inserted in the slot 35, will generate a split current to enter the circuit provided in the circuit board 70 from the contact pin 72, due to the contacts of the contact pins 72 with the second and fifth contacts 24A, 29A. The signals/currents are processed or transformed by the circuit and output to external. A parallel connection of the circuit board is thus realized.

In the process describe above, when the extension 71 of the circuit board 70 forces one of the two pairs of contacts, i.e., the second contact 24A and the fifth contacts 24A, and the third contact 25A and the sixth contact 30A, to separate, the other pair remains in contact or is already separated.

When the extension 71 of the circuit board 70 is removed from one of the two pairs, the other pair remains in contact or is already separated. In either of these situation, Sudden break or sudden short in the circuit due to the break or short of the contacts will never take place.

In short, the present invention provides a connector module that supports the hot-swap function. With the present invention, sudden short or break due to the insertion or removal of a foreign circuit may be prevented.

Figure 9:
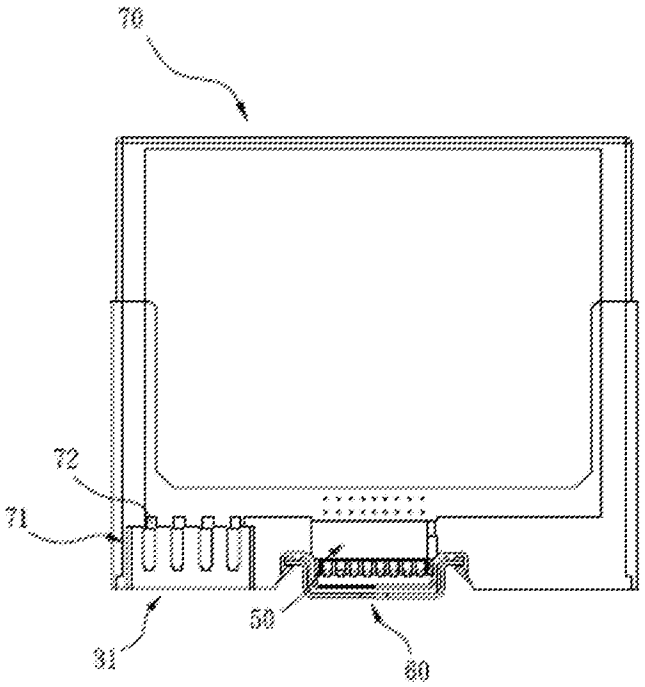
FIG. 9 illustrates one example of the invented connector module after assembly.

A connector module with the structure described above provides one or more serial/parallel connectors 31 and a bus connector seat 40 to accommodate a bus connector 50. In application, a circuit board 70 provided with a bus connector 50 may be installed by inserting the bus connector 50 into the bus connector seat 40 and the extension 71 of the circuit board 70 into the slot 35 of the serial/parallel connector 31, to assemble the connector module 100 and the circuit board 70. A functional module assembly so obtained is shown in FIG. 9. Thereafter, the a plurality of functional modules with an identical or similar connector module 100 is arranged closely in sequence in the bus rail 60, by having their slidable clamps 43 clamping the same bus rail 60. Circuits provided in a circuit boards 70 will form serial or parallel connections with circuits provided in another circuit board 70 through the serial/parallel connector 31, or form bus connections through the bus connector 90, depending on the design of the system. A three-mode connection function is thus realized.

Figure 6:
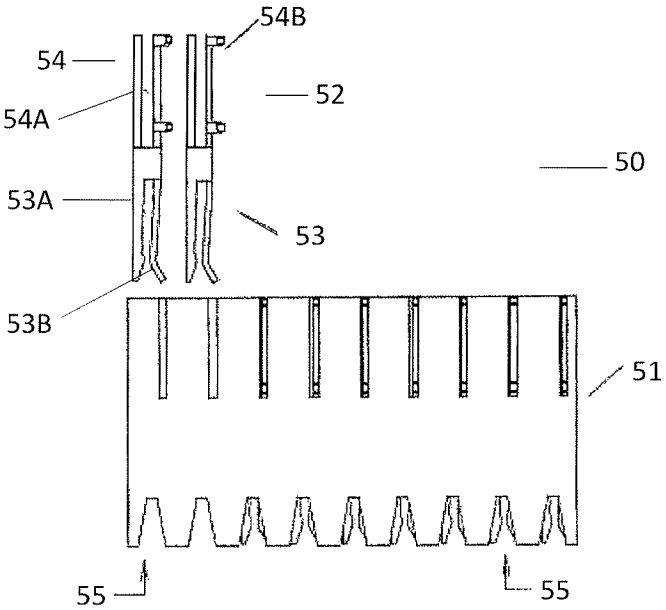
FIG. 6 shows one example of a bus connector applicable in the connector module of the present invention.

Of course, the connector module 100 may also include a bus connector 50, with detachable connector pins to contact the metal pins, such as goldfingers provided in the circuit board 70. FIG. 6 shows the structure of a bus connector 50 applicable in the connector module 100 of this invention. As shown in this figure, the bus connector 50 comprises a connector main body 51 and a plurality of connector pins 52 provided in the connector main body 51. Each connector pins 52 comprises a first terminal 53 and a second terminal 54, extended in opposite directions. The first terminal 53 includes two legs 53A, 53B, to form contact with and to clamp a metal strip 62 provided in the bus structure 61 accommodated in the bus rail 60, in order to establish stable electrical contact thereto. The second terminal 54 includes two legs 54A, 54B, to form contact with and to clamp a metal pin provided in the circuit board 70, in order to establish stable electrical contact thereto. A same number of pin slots 55 is provided in the connector main body 51, to accommodate the connector pins 52. A bus connector 50 with the structure described above may be inserted and attached in the bus connector seat 40 of the module main body 10. When the bus connector 50 is accommodated in the bus connector seat 40, the first terminals 53 extend from the connector main body 51. When the slidable clamp 43 clamps the bus rail 60, the connector pins 52 of the bus connector will contact the metal strips 62 of the bus structure 61 accommodated in the bus rail 60 and form electrical contact thereto. A bus connection is thus established.

In the preferred embodiments, the second terminals 54 are not metal legs, but are soldered onto the circuit board 70. In such embodiments, the circuit board 70, including a bus connector 50) is assembled with the connector module 100 by inserting the circuit board 70 between the guide arms 11, 12.

A bus connector 60 with features described above is described in US patent publication No. 2013-237067 "Data bus structure for terminal blocks and terminal blocks using the same," which description may be taken as reference in this disclosure.

Figure 7:
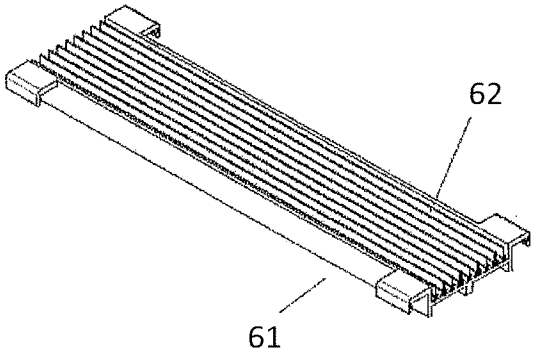
FIG. 7 shows one example of a bus structure applicable in the connector module of the present invention.
Figure 8:
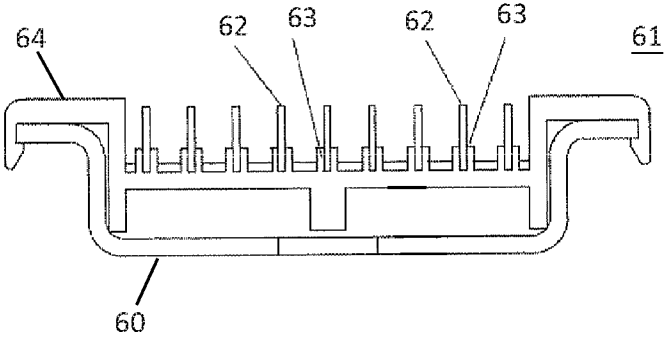
FIG. 8 shows the cross-sectional view of the bus structure of FIG. 7.

As mentioned above, the support rail 60 is a standard product in the industry, used to support functional modules such as terminal blocks. A bus structure applicable in this invention is designed in accordance with such support rail. FIG. 7 shows the structure of a bus structure 61 usable in the connector module of this invention. FIG. 8 shows its cross-sectional view. As shown in these figures, the bus structure 61 is a block material with a plurality of elongated slots 63 provided thereon. The elongated slots 63 extend in the longitudinal direction of the bus structure 61, which is perpendicular to the first direction X. As a result, a plurality of connector modules 100 may be arranged in sequence on the bus structure 61 with their respective bus connectors 50 in connection with the metal strips 62, as well as their serial/parallel connectors 31 connected in sequence.

The shape of the bus structure 61 is not limited, as long as it may be accommodated in the bus rail 60 to well utilize the space provided by the standard support rail, without additionally modifying the support rail. A metal strip 62 is provided in each of the elongated slots 63, such that the plurality of metal strips 62 are arranged parallel. The metal strips 62 thus form a bus, or data bus, for the transmission of electrical power and/or signals. In the example of FIGS. 7 and 8, the bus structure is attached in the bus rail 60 by two wings 64. The wings 64, however, are not absolutely necessary, because, when application, the connector module 100 has been clamped to the bus rail 60 by its slidable clamp 43 and connected to the bus structure 61 with its bus connector 50, whereby stable connection between them has been well established.

The bus connector 50 may enter into the opening 42 along the first direction X and move along the rail 41, 41, until the connector pins 52 of the bus connector 50 are exposed from the other side of the opening 42. The connector module 100 is clamped to the bus rail 60 with its slidable clamp 43, so that the connector pins 52 of the bus connector 50 are in electrical contact with the plurality of metal strips 62 of the bus structure 61. A bus connection is thus realized.

A bus structure 61 with features described above is also described in US patent publication No. 2013-237067 "Data bus structure for terminal blocks and terminal blocks using the same," which description may be taken as reference in this disclosure.

FIG. 9 shows one example of the invented connector module after assembly. As shown, when a bus connector 50 is provided in the bus connector seat 40 of the connector module 100, the bus connector pins 52 of the bus connector 50 will establish electrical contacts with the metal strips 62 of the bus structure accommodated in the bus rail 60. When a plurality of connector module 100 is arranged in sequence on the bus rail 60, the first and fourth contacts 24A, 28/A of the serial/parallel connector 31 of one contact module are respectively in contact with the fourth and first contacts 28A, 24A of the serial/parallel connectors 31 of an adjacent contact module.

As describe above, the present invention provides a tri-modal connector module that has a simple structure and is applicable in the industry for a variety of applications.

What is claimed is:

1. A connector module, comprising:

a module main body, a serial/parallel connector detachably attached in the module main body, and a bus connector seat; wherein the serial/parallel connector comprises:

an insulation main body having a slot; and at least one group of connection terminals fixed on the insulation body, each group of connection terminals including a first contact piece and a second contact piece; wherein the first contact piece provides an external first contact and internal second and third contacts, the internal second and third contacts being arranged along a first direction in the slot;

the second contact piece provides an external fourth contact and internal fifth and sixth contacts, the internal fifth and sixth contacts being arranged along the first direction in the slot and in resilient contact with the second and third contacts, respectively;

a width of the slot in the direction perpendicular to the first direction is enough to accommodate a foreign object, whereby when the foreign object enters into the slot in the first direction, contact between the second and fifth contacts or the third and sixth contacts is released; and when the serial/parallel connector is assembled in the module main body, the first and fourth contacts of each connector terminal group are positioned external at both sides of the module main body;

and wherein the bus connector seat is provided in the module main body and comprises:

a slide rail formed inside an opening of the module main body to provide slidable attachment and accommodation of a bus connector, and a slidable clamp positioned at one end of the opening to be aligned to a bus rail, to clamp the bus rail for attachment of the connector module; wherein the opening provides a space along the slide rail and opened to the clamp, such that connector pins of the bus connector may reach a bus structure in the bus rail.

2. The connector module of claim 1, wherein the first contact piece comprises a connection portion and a first elastic leg, a second elastic leg and a third elastic leg extended from the connection portion, such that the first contact, the second contact and the third contact are provided in the first elastic leg, the second elastic leg and the third elastic leg, respectively and wherein the second contact piece comprises a main body and a fourth elastic leg, a fifth elastic leg and a sixth elastic leg extended from the main body, such that the fourth contact, the fifth contact and the sixth contact are provided in the fourth elastic leg, the fifth elastic leg and the sixth elastic leg, respectively.

3. The connector module according to claim 1, wherein when a foreign object is inserted into the slot along the first direction, the foreign object first contacts the second and fifth contacts; when the foreign object moves along the first direction, connection of the second and fifth contacts is forced to break, therefore the contact status of the second contact and the fifth contact is released; when the foreign object continues to move along the first direction and contacts the third contact and sixth contacts, connection of the third contact and sixth contacts is forced to break, therefore the contact status of the third and sixth contacts is released.

4. The connector module according to claim 2, wherein when a foreign object is inserted into the slot along the first direction, the foreign object first contacts the second and fifth contacts; when the foreign object moves along the first direction, connection of the second and fifth contacts is forced to break, therefore the contact status of the second contact and the fifth contact is released; when the foreign object continues to move along the first direction and contacts the third contact and sixth contacts, connection of the third contact and sixth contacts is forced to break, therefore the contact status of the third and sixth contacts is released.

5. The connector module according to claim 1, further comprising a bus connector that comprises a plurality of bus connector pins; wherein the bus connector may enter into the opening along the first direction and move along the slide rail, until the connector pins of the bus connector are exposed from the other end of the opening.

6. The connector module according to claim 5, wherein the bus rail extends along a second direction perpendicular to the first direction, so that one bus rail supports a plurality of connector modules parallel arranged.

7. The connector module according to claim 6, wherein a bus structure is accommodated in the bus rail and wherein the bus structure includes a bus structure main body to be accommodated in the bus rail and a plurality of metal strips each extending along the second direction and arranged parallel to other metal strips, to be connected by a plurality of bus connector arranged in sequence.

8. The connector module according to claim 5, wherein the bus connector provides a plurality of modular connector pins, for connector pins of particular circuit module to connect.

9. The connector module according to claim 5, wherein the bus connector further provides a substrate, provided with circuit modules thereon.

10. The connector module according to claim 9, wherein the substrate provides an extension to be inserted into the slot of the serial/parallel connector.

* * * * *